US007811067B2

(12) United States Patent
Dietzsch et al.

(10) Patent No.: US 7,811,067 B2
(45) Date of Patent: Oct. 12, 2010

(54) AIR DRIVEN PUMP WITH PERFORMANCE CONTROL

(75) Inventors: Curtis W. Dietzsch, Moreno Valley, CA (US); Greg S. Duncan, Huntington Beach, CA (US); Gary K. Lent, Riverside, CA (US)

(73) Assignee: Wilden Pump and Engineering LLC, Grand Terrace, CA (US)

( * ) Notice: Subject to any disclaimer, the term of this patent is extended or adjusted under 35 U.S.C. 154(b) by 1130 days.

(21) Appl. No.: 11/407,878

(22) Filed: Apr. 19, 2006

(65) Prior Publication Data

US 2007/0248474 A1 Oct. 25, 2007

(51) Int. Cl.
*F04B 49/00* (2006.01)
*F16K 47/00* (2006.01)

(52) U.S. Cl. ..... 417/298; 417/395; 137/556; 251/112; 251/121; 251/126; 251/208; 251/209

(58) Field of Classification Search ..... 417/298, 417/393, 395; 137/556, 126; 251/205, 215, 251/218, 208, 209, 112, 121, 126
See application file for complete search history.

(56) References Cited

U.S. PATENT DOCUMENTS

| | | | | | |
|---|---|---|---|---|---|
| 3,071,118 | A | | 1/1963 | Wilden | 121/157 |
| 3,741,689 | A | | 6/1973 | Rupp | 417/393 |
| 3,838,946 | A | * | 10/1974 | Schall | 417/395 |
| 4,247,264 | A | | 1/1981 | Wilden | 417/393 |
| 4,266,571 | A | * | 5/1981 | Bauder | 137/625.48 |
| 4,339,985 | A | | 7/1982 | Wilden | 91/307 |
| D275,858 | S | | 10/1984 | Wilden | D15/7 |
| 4,549,467 | A | | 10/1985 | Wilden et al. | 91/307 |
| D294,946 | S | | 3/1988 | Wilden | D15/7 |
| D294,947 | S | | 3/1988 | Wilden | D15/7 |
| 4,927,335 | A | * | 5/1990 | Pensa | 417/393 |
| 4,995,421 | A | | 2/1991 | Bonacorsi et al. | 137/383 |
| 5,081,904 | A | | 1/1992 | Horn et al. | 91/420 |
| 5,169,296 | A | | 12/1992 | Wilden | 417/395 |

(Continued)

OTHER PUBLICATIONS

"Proportional." Dictionary.com Unabridged. Random House, Inc. Nov. 3, 2009. <Dictionary.com http://dictionary.reference.com/browse/proportional>.*

*Primary Examiner*—Devon C Kramer
*Assistant Examiner*—Leonard J Weinstein
(74) *Attorney, Agent, or Firm*—Connolly Bove Lodge & Hutz LLP

(57) ABSTRACT

An air driven diaphragm pump includes an performance control actuator having a housing with opposed air chambers. The pump includes pump chambers facing the air chambers and pump diaphragms extending between each air chamber and each pump chamber, respectively. The actuator further includes an air valve, an intake to the air valve and an engagement. The intake includes an intake passage and a performance control intake adjuster rotatably mounted. The intake adjuster has a helical channel and a closure element extending adjustably into the intake passage. The engagement engages the helical channel for control of the intake. The helical channel has varied pitch to provide a nonlinear relationship between rotation and axial advancement of the intake adjuster. The nonlinear relationship gives flow rate proportional to the angular rotation of the intake adjuster. The end points of the channel provide a practical minimum pump performance of about 40% of maximum pump flow rate and a maximum pump performance of about 97% of maximum pump flow rate.

11 Claims, 3 Drawing Sheets

U.S. PATENT DOCUMENTS

| | | | | | |
|---|---|---|---|---|---|
| 5,213,485 | A | | 5/1993 | Wilden | 417/393 |
| 5,567,118 | A | * | 10/1996 | Grgurich et al. | 417/46 |
| 5,950,623 | A | * | 9/1999 | Michell | 128/205.24 |
| 5,957,670 | A | | 9/1999 | Duncan et al. | 417/395 |
| RE38,239 | E | * | 8/2003 | Duncan | 417/395 |
| 7,093,821 | B2 | * | 8/2006 | Howe | 251/218 |
| 7,517,199 | B2 | * | 4/2009 | Reed et al. | 417/46 |
| 2005/0249612 | A1 | | 11/2005 | Distaso et al. | |
| 2006/0038148 | A1 | | 2/2006 | Chen | 251/208 |

* cited by examiner

AIR DRIVEN PUMP WITH PERFORMANCE CONTROL

BACKGROUND OF THE INVENTION

The field of the present invention is pumps and actuators for pumps which are air driven.

Pumps having double diaphragms driven by compressed air directed through an actuator valve are well known. Reference is made to U.S. Pat. Nos. 5,957,670; 5,213,485; 5,169,296; and 4,247,264; and to U.S. Pat. Nos. Des. 294,947; 294,946; and 275,858. These air driven diaphragm pumps employ actuators using feedback control systems which provide reciprocating compressed air for driving the pumps. Reference is made to U.S. Patent Application Pub. No. 2005/0249612 and to U.S. Pat. No. 4,549,467. Another mechanism to drive an actuator by solenoid is disclosed in U.S. Pat. No. RE 38,239. The disclosures of the foregoing patents and patent application publication are incorporated herein by reference.

Other pumps may be driven by the same actuators but use other arrangements of operatively opposed air actuating chambers to drive a reciprocating pumping mechanism. Pistons with ring seals in a cylinder are also known for the provision of operatively opposed air chambers. Reference is made to U.S. Pat. No. 3,071,118. The disclosure of this patent is also incorporated herein by reference.

Common among the disclosed devices in the aforementioned patents directed to air driven diaphragm pumps is the presence of an actuator housing having air chambers facing outwardly to cooperate with pump diaphragms. Outwardly of the pump diaphragms are pump chamber housings, inlet manifolds and outlet manifolds. Passageways transition from the pump chamber housings to the manifolds. Ball check valves are positioned in both the inlet passageways and the outlet passageways. The actuator between the air chambers includes a shaft running therethrough which is coupled with the diaphragms located between the air chambers and pump chambers. A vast variety of materials of greatly varying viscosity and physical nature are able to be pumped using such systems.

Actuators for air driven pumps commonly include an air valve which controls flow to alternate pressure and exhaust to and from each of the air chambers, resulting in reciprocation of the pump. The air valve is controlled by a pilot system controlled in turn by the position of the pump diaphragms or pistons. Thus, a feedback control mechanism is provided to convert a constant air pressure into a reciprocating distribution of pressurized air to each operatively opposed air chamber.

Actuators defining reciprocating air distribution systems are employed to substantial advantage when shop air or other convenient sources of pressurized air are available. Other pressurized gases are also used to drive these products. The term "air" is generically used to refer to any and all such gases. Driving products with pressurized air is often desirable because such systems avoid components which can create sparks. The actuators can also provide a continuous source of pump pressure by simply being allowed to come to a stall point with the pressure equalized by the resistance against the pump. As resistance against the pump is reduced, the system will again begin to operate, creating a system of operations on demand.

In using such actuators to drive such pumps, greatly varying demands can be experienced. Viscosity of the pumped material, suction head or discharge head and desired flow rate impact operation. Typically the source of pressurized air is relatively constant. Consequently, pump operation finds maximum flow limited by such things as suction and pressure head and fluid flow resistance. Below the maximum capability of the pump, flow rate, including a zero flow rate with the pump still pressurized, has been controlled through restrictions in the output of the pump. Tuning of the actuator exhaust relative to the inlet has also been used for permanent pump efficiency settings.

It remains that control of either the output of the pump or the exhaust of the actuator can alter the performance of the pump to achieve desired flow rates below the maximum but such control does not address both efficient operation and variation in demands placed on the pump.

SUMMARY OF THE INVENTION

The present invention is directed to air driven pumps using an actuator having a reciprocating air valve with opposed air chambers. The actuator includes an intake to the air valve having an intake passage and an adjuster controlling flow through the intake passage. The adjuster includes a closure element which adjustably extends into the intake passage to the air valve. Employment of the intake adjuster allows a balancing of pump flow with varying pump efficiency.

Through restriction, the charge of air on the pumping stroke can be reduced under light and moderate pumping loads. This lessens the demand on the exhaust side as less accumulated pressure must be released. Further, pumping can be achieved with less build up of pressure when full pressure cannot deliver a proportionally greater flow, typically due to pumped material flow constraints, or when full flow is not needed. Efficient reduction in power requirements is achieved by reducing the driving air pressure within the air chambers rather than through back pressure imposed on the pumped material or powering air.

In a first separate aspect of the present invention, the adjuster is located in the actuator housing to provide predictable performance adjustments on the air valve and associated pump.

In a second separate aspect of the present invention, a nonlinear control on the actuator is provided. At low airflow rates, intake adjuster position becomes proportionally more sensitive. The nonlinear control can also be configured to make changes in air consumption by the actuator substantially directly proportional to the settings of the actuator.

In a third separate aspect of the present invention, the intake adjuster has a helical shoulder and a closure element extending adjustably into the intake passage. An engagement is fixed relative to the intake passage and extends to operatively engage the helical shoulder. One configuration includes the helical shoulder being associated with a rotatable adjuster element that has a varying pitch along its length. The shoulder may be defined by a channel in the adjuster.

In a fourth separate aspect of the present invention, the intake adjuster includes a helical channel and a closure element extending adjustably into the intake passage. An engagement fixed relative to the intake passage and extends to operatively engage the helical channel. In one configuration, the intake adjuster may be rotatably mounted in the actuator housing and cylindrical in cross section. A sealing groove may be advantageously placed between the channel and the closure element.

In a fifth separate aspect of the present invention, the actuator has a maximum air flow setting which provides substantially 97% of the maximum possible pump capacity.

In a sixth separate aspect of the present invention, any of the foregoing aspects may be combined to greater advantage.

Accordingly, it is an object of the present invention to provide an improved air driven pump. Other and further objects and advantages will appear hereinafter.

DETAILED DESCRIPTION OF THE PREFERRED EMBODIMENT

Figure 1:
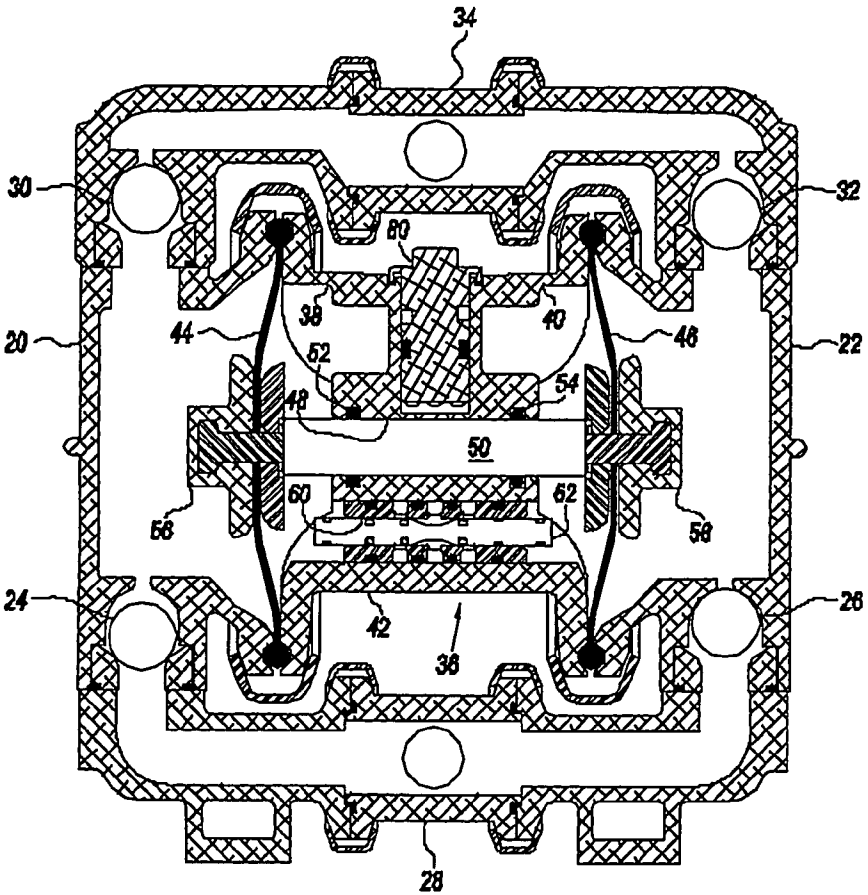
FIG. 1 is a vertical cross section of an air driven double diaphragm pump.

Turning in detail to the Figures, an air driven double diaphragm pump is illustrated in FIG. 1. The principles applicable to the pump construction and operation contemplated in this preferred embodiment are fully described in U.S. Pat. No. 5,957,670, the disclosure of which is incorporated herein by reference.

The pump structure includes two pump chamber housings, 20, 22. These pump chamber housings 20, 22 each include a concave inner side forming pumping cavities through which the pumped material passes. One-way ball valves 24, 26 are at the lower end of the pump chamber housings 20, 22, respectively. An inlet manifold 28 distributes material to be pumped to both of the one-way ball valves 24, 26. One-way ball valves 30, 32 are positioned above the pump chamber housings 20, 22, respectively, and configured to provide one-way flow in the same direction as the valves 24, 26. An outlet manifold 34 is associated with the one-way ball valves 30, 32.

Figure 4:
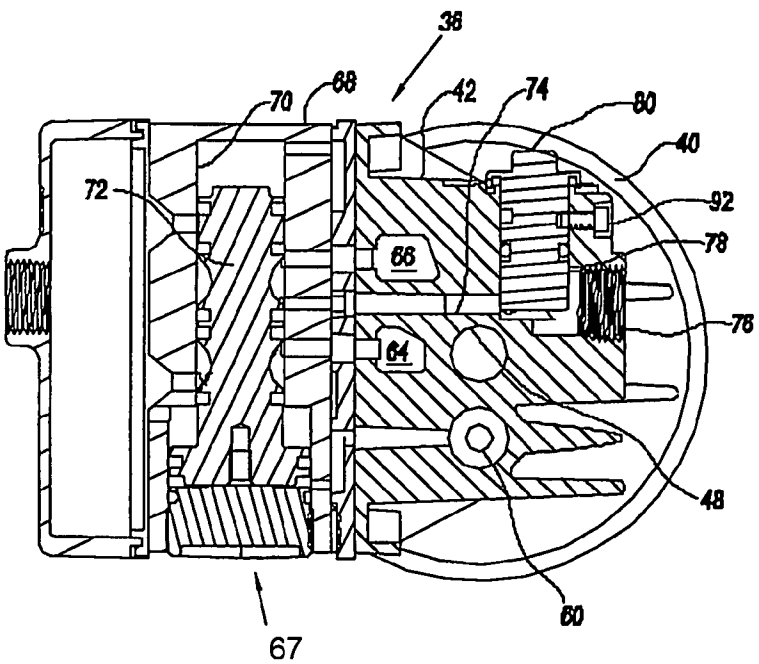
FIG. 4 is a vertical cross sectional view of the actuator.
Figure 3:
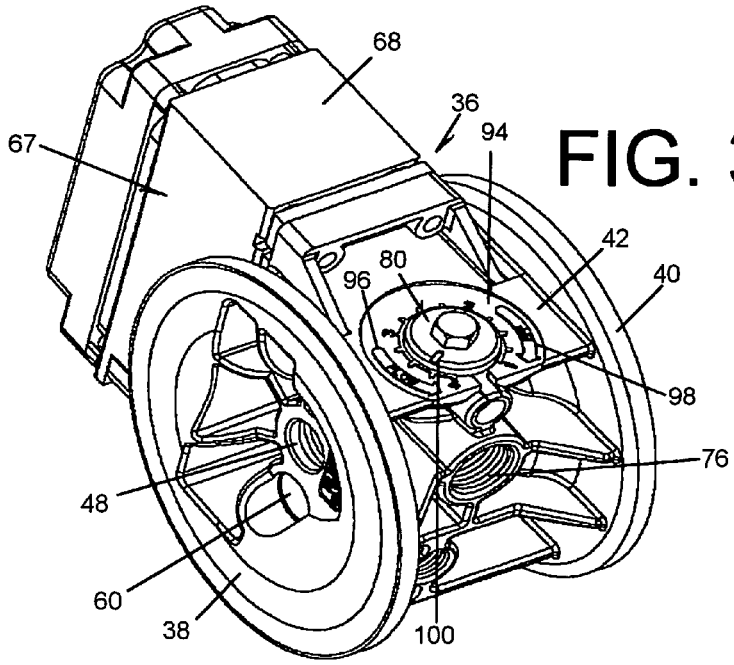
FIG. 3 is a perspective view of the actuator.
Figure 2:
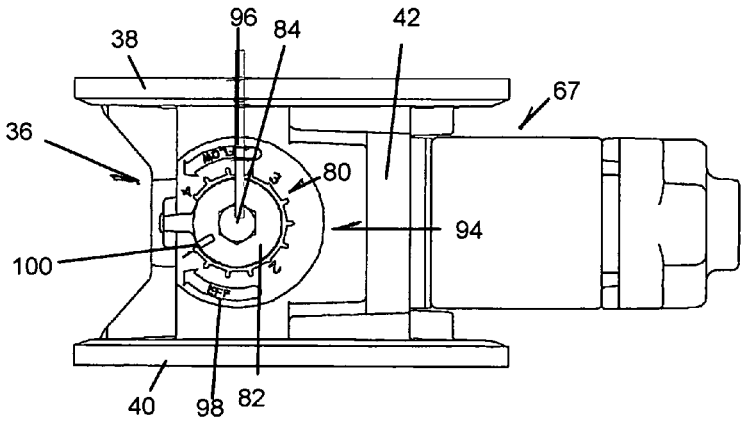
FIG. 2 is a top view of an actuator.

Inwardly of the pump chamber housings 20, 22, a center section, generally designated 36, defines an actuator illustrated in FIGS. 2, 3 and 4. The actuator includes air chambers 38, 40 to either side of an actuator housing 42. Air pressure in the air chambers 38, 40 provides forces in opposite directions and thus define operatively opposed chambers. There are two pump diaphragms 44, 46 arranged in a conventional manner between the pump chamber housings 20, 22 and the air chambers 38, 40, respectively, illustrated in FIG. 1. The pump diaphragms 44, 46 are retained about their periphery between the corresponding peripheries of the pump chamber housings 20, 22 and the air chambers 38, 40.

As illustrated in FIGS. 1, 3 and 4, the actuator housing 42 provides a first guideway 48 which is concentric with the coincident axes of the air chambers 38, 40 and extends to each air chamber. A shaft 50 is positioned within the first guideway 48. The guideway 48 provides channels for seals 52, 54 as a mechanism for sealing the air chambers 38, 40, one from another, along the guideway 48. The shaft 50 includes piston assemblies 56, 58 on each end thereof. These assemblies 56, 58 include elements which capture the centers of each of the pump diaphragms 44, 46. The shaft 50 causes the pump diaphragms 44, 46 to operate together to reciprocate within the pump.

Also located within the actuator housing 42 is a second guideway 60 within which a pilot shifting shaft 62 is positioned. The guideway, defined by a bushing, extends fully through the center section to the air chambers 38, 40 with countersunk cavities at either end. The pilot shifting shaft 62 extending through the second guideway 60 also extends beyond the actuator housing 42 to interact with the inside surface of the piston assemblies 56, 58. The pilot shifting shaft 62 can extend into the path of travel of the interfaces of either one of the assemblies 56, 58. Thus, as the shaft 50 reciprocates, the pilot shifting shaft 62 is driven back and forth.

The actuator 36 in the preferred embodiment is mechanically and operatively illustrated in principle in U.S. Patent Application Publication No. 2005/0249612, the disclosure of which is incorporated herein by reference.

The housing 42 of the actuator 36 additionally includes air chamber passages 64, 66 extending from the opposed air chambers 38, 40. These air chamber passages 64, 66 provide compressed air to drive the pump diaphragms 44, 46 and also provide passages for exhausting the air chambers.

Part of the actuator housing 42 is defined by a separable cylinder housing portion, generally indicated as 67, attached to one wall of the main body of the housing 42 defining an air valve 68. The air valve 68 includes a cylinder 70 which communicates with the air chambers 38, 40 through the air chamber passages 64, 66. An unbalanced spool 72 provides a valve element within the cylinder 70.

An intake is provided in the housing 42 to direct pressurized air through an intake passage 74 into the cylinder 70. As illustrated in U.S. Pat. No. 5,957,670 and in U.S. Patent Application Publication 2005/0249612, the intake passage 74 may include a portion divided into three individual passageways leading from a threaded port 76 to the cylinder 70. A cylindrical bore 78 extends perpendicularly to the intake passage 74 downstream of the threaded port 76. The intake passage may include an extended flow path outwardly of the threaded port 76 and the actuator housing 42 as well.

Figure 5:
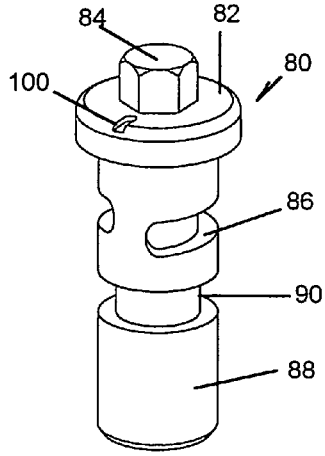
FIG. 5 is a perspective view of an intake adjuster.
Figure 6:
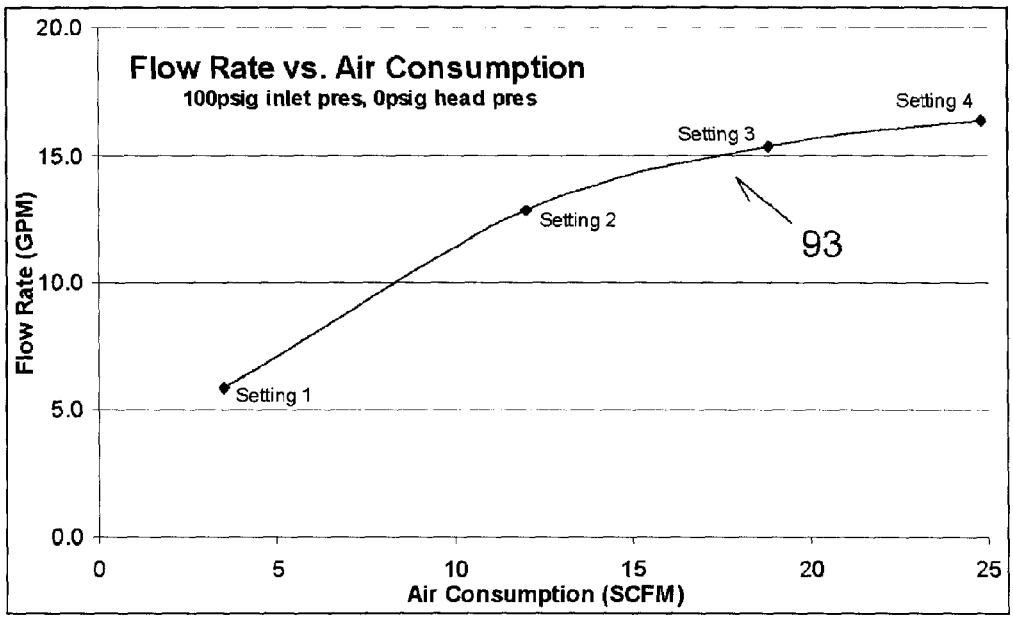
FIG. 6 is a graph illustrating flow rate vs. air compression for one exemplar pump.

As illustrated in FIGS. 2, 3 and 4, a cylindrical intake adjuster 80 is positioned in the cylindrical bore 78. The cylindrical intake adjuster 80, best illustrated in FIG. 5, includes a cover plate 82 with an integral hex head 84 at one end. The cylindrical body of the intake adjuster 80 includes a helical channel 86. The channel 86 has two ends with one end lower than the other by virtue of the helical arrangement. The bottom of the cylindrical intake adjuster 80 provides a closure element 88 which extends adjustably into the intake passage 74. A sealing groove 90 is arranged between the helical channel 86 and the closure element 88. The sealing groove 90 accommodates an O-ring to seal off the intake passage 74 from venting through the cylindrical bore 78. The O-ring also acts to keep the adjuster 80 angularly fixed in place in the housing 42.

The actuator 36 further includes an engagement 92. In the preferred embodiment, the engagement 92 is a threaded pin which extends through the housing 42 into the cylindrical bore 78. The engagement 92 is axially fixed relative to the intake adjuster and extends to the channel 86 for engagement therewith.

The helical channel 86 defines two parallel helical shoulders, one defining the location of the adjuster 80 in cooperation with the engagement 92 against possible ejection out of the cylindrical bore 78 from the pressure in the intake passage 74. The shoulders define the axial location of the adjuster 80 in the cylindrical bore 78. Because the engaged channel 86 is helical, rotation of the intake adjuster 80 raises and lowers the adjuster 80 to extend more or less into the intake passage 74.

The helix of the channel 86 is of varied pitch making the relationship between rotation and advancement of the adjuster 80 nonlinear. The configuration of the channel 86 is such that the ratio of advancement to rotation of the adjuster decreases with the intake passage being progressively restricted by the adjuster. The nonlinear pitch of the channel 86 increases sensitivity of actuation where axial advancement of the adjuster 80 has the most critical effect. Additionally, the pitch of the channel 86 can be further configured to make the change in flow rate through the inlet passage 74 substantially proportional to the angular rotation of the intake adjuster 80, as well be seen in the graph below. This provides an intuitive adjustment to air consumption impacting efficiency without requiring air flow monitoring. The channel 86 also extends only partially around the adjuster 80, about 300°. This avoids one end of the channel 86 intersecting the other end.

The axial locations of the end points of the channel 86 are dictated by the configuration of the pump and actuator valve as empirically determined. An example of one pump is illustrated in the included graph with curve 93 illustrating the relationship between flow rate and air consumption thereof. This pump was run with a constant 100 psi air pressure and pumped water without head pressure.

Where rapid flow is not essential, the adjuster 80 can be rotated so that the upper end of the helical channel 86 approaches the engagement 92, Setting 1. In this circumstance, pump efficiency is increased.

The adjuster 80 substantially blocks the intake passage 74 when at Setting 1. At Setting 1, the adjuster 80 is most advanced into the cylinder 78 with the engagement 92 at the upper end of the channel 86, constituting a maximum selected restriction. At Setting 1, the flow rates are 5.9 GPM for the pump and 3.5 SCFM for the actuator. This setting has a much higher pump performance ratio, which is the ratio of pump flow to air consumption, then when the intake passage 74 is wide open. However, this high pump performance ratio is gained at the expense of low pump capacity. Setting 1 has been selected as a practical lower flow limit at approximately 40% of maximum flow of a given pump with no air inlet or actuator restrictions.

When the pump is operating against low resistance, as in this example, the airflow is so low that the air chamber being pressurized never reaches the full pressure of the inlet supply air. Before doing so, the pump reaches the end of its stroke and the actuator reverses. This result provides an improved performance ratio with low pump resistance. First, there is less air employed. Second, there is less exhaust resistance from the exhausting air chamber as it also did not achieve full pressure. At the same time, as pump resistance increases, the actuator will allow pressure buildup to meet the increased pressure required.

Continuing with the same example in the above graph, when the adjuster 80 is displaced furthest from the intake passage 74, the engagement 92 is positioned at the lower end of the channel 86. This provides the least restriction as the adjuster 80 is at its uppermost position. This is represented by Setting 4 in the above graph which is at 16.4 GPM for the pump and 24.8 SCFM for the actuator. At Setting 4, the performance ratio is lower while high pump flow is advantageously realized.

Because of flow constraints in the pump, the pump performance ratio decreases exponentially near maximum pump flow rate. This can be seen in the decreasing slope of the above graph as air flow rates increase. In other words, the air flow vs. pump flow curve illustrated in the above graph becomes virtually asymptotic to a maximum pump flow rate regardless of the amount of air provided unless pressure is increased. As air is supplied at a constant pressure to the intake passage 74, air flow rate will also reach a maximum but not asymptotically.

The maximum intake flow in the absence of an adjuster does allow rapid filling of the air chamber as part of a power stroke. Rapid filling provides maximum pump flow rate but has a low pump performance ratio. Of course, the actual flow rate from the pump depends on suction head, outlet head, viscosity of the fluid pumped and the like. The more viscous the material being pumped, the more power that is demanded for rapid flow. Even with less viscous liquids and small differential pumping pressures, flow rates beyond the effective level of operation require a disproportionate amount of power. Therefore, where the intake passage 74 is of sufficient size and the remainder of the flow passages do not constrain flow more than the intake passage 74, the free flow of compressed air will provide the greatest amount of pump flow but can exceed an effective level of operation.

Setting 4, established when the engagement 92 is located at the lower end of the helical channel 86, is empirically placed to constrain air flow through the intake passage 74 to effectively maximize flow while operating at an acceptable performance ratio. This acceptable setting is approximately 97% of maximum pump flow for a given pump design. The graph can be used to calculate that the pump performance ratio which is the lowest at Setting 4, defining a minimum selected restriction.

The actuator housing 42 has an efficiency indicator, generally designated 94, around the cylindrical intake adjuster 80, as best illustrated in FIG. 2. This indicator 94, which may be molded into the housing 42 for greatest longevity, includes indicia indicative of the minimum and maximum settings, Setting 1 and Setting 4, respectively. Oppositely directed arrows 96, 98 indicate directions of angular rotation of the cylindrical intake adjuster 80 for increasing flow and increasing efficiency, respectively. Two intermediate angular positions between Setting 1 and Setting 4 are indicated. These intermediate angular positions, Settings 2 and 3, also reflected in the above graph, are equiangularly spaced.

Each of the angular settings, Settings 1 through 4, reflects an axial setting of the cylindrical intake adjuster 80 relative to the intake passage 74 effecting an air flow rate because of cooperation between the helical channel 86 and the engagement 92. The two intermediate angular positions reflect Setting 2 at 12.8 GPM for the pump and 12 SCFM for the actuator and Setting 3 at 15.3 GPM for the pump and 18.8 SCFM for the actuator. An indicator notch 100 is found on the cover plate 82.

The settings on the efficiency indicator 94, in cooperation with the notch 100, may be used to assist in adjusting the intake to recreate repeated conditions and the like. The four equiangularly spaced settings reflect increments of change in air flow that are substantially equal. This relationship, dependent upon the configuration of the nonlinear pitch of the helical channel 86, provides intuitive control of efficiency without requiring air flow measurements and gives equal sensitivity of control throughout the full range of air flow adjustment.

Pump performance ratios for the settings 1 through 4 are respectively 1.69, 1.07, 0.81 and 0.66. At the same time that obvious efficiencies are gained by slower operation, output decreases. The operator must determine where to set the adjuster for effective operation as needed. More viscous material pumped or increased head is anticipated to shift the curve of the above graph down to overcome the increased resistance.

Thus, an air driven pump having a variable inlet to allow the selection of high pump output or high pump efficiency is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. An air driven pump comprising a. an actuator including 1) operatively opposed air chambers, 2) air chamber passages, 3) an air valve having a) a cylinder in communication with the air chambers through each air chamber passage, respectively, b) a valve element in the cylinder, 4) an intake passage extending to the cylinder, 5) an intake adjuster having a) a closure element operatively mounted to move axially into and out of the intake passage with angular rotation of the closure element to selectively restrict the air flow rate in the intake passage, the ratio of advancement of the closure element to angular rotation of the closure element decreasing with the intake passage being progressively restricted by the closure element, and b) a first angular position with the intake passage at maximum selected restriction, c) a second angular position with the intake passage at minimum selected restriction, changes in flow rate through the inlet being equal for equal incremental angular rotation of the closure element between the first angular position and the second angular position, and b. a pump body including 1) at least one variable volume pump chamber and 2) a pumping element driven by the operatively opposed air chambers.

2. The air driven pump of claim 1, the intake adjuster further having d) a plurality of intermediate angular positions defined by indicia between the first and second angular positions, the first, second and plurality of intermediate angular positions being equiangularly spaced, each angular position having a corresponding axial position effecting an air flow rate, the changes in the effected air flow rates between adjacent equiangularly spaced axial positions being substantially equal.

3. The air driven pump of claim 1, the intake adjuster further including e) a helical shoulder on the closure element, the actuator further including 6) an engagement fixed relative to the intake passage and extending to operatively engage the helical shoulder.

4. The air driven pump of claim 3, the intake adjuster further including f) a channel in the closure element, the helical shoulder being defined by one side of the channel.

5. The air driven pump of claim 2, the plurality of intermediate angular positions being two intermediate angular positions.

6. The air driven pump of claim 1, the actuator further including 6) an actuator housing, the intake adjuster being mounted in the actuator housing.

7. An air driven pump comprising a. an actuator including 1) an actuator housing, 2) operatively opposed air chambers, 3) air chamber passages, 4) an air valve in the actuator housing having a) a cylinder in communication with the air chambers through each air chamber passage, respectively, b) a valve element in the cylinder, 5) an intake having a) an intake passage in the actuator housing extending to the cylinder and b) an intake adjuster being rotatably mounted in the actuator housing selectively restricting the intake passage and cylindrical in cross section and having (1) a helical channel, (2) a closure element extending adjustably into the intake passage, wherein the closure element is cylindrical in cross section and received in a cylindrical bore within the actuator housing, (3) a sealing groove between the helical channel and the closure element, and 6) an engagement fixed relative to the intake passage and extending to operatively engage the helical channel;

b. a pump body including 1) at least one variable volume pump chamber and 2) a pumping element driven by the operatively opposed air chambers.

8. The air driven pump of claim 7, the helical channel being configured for axial movement of the intake adjuster in the intake passage with rotation of the intake adjuster.

9. The air driven pump of claim 8, the helical channel including (a) a varying pitch along its length.

10. The air driven pump of claim 9, the varying pitch of the helical channel being configured so that the ratio of advancement to rotation of the intake adjuster decreases with the intake passage being progressively restricted by the intake adjuster.

11. The air driven pump of claim 7, the channel in the intake adjuster extending no more than 300° about the intake adjuster.

* * * * *